US010876524B2

(12) United States Patent
Hu et al.

(10) Patent No.: US 10,876,524 B2
(45) Date of Patent: Dec. 29, 2020

(54) LINEAR COMPRESSOR

(71) Applicant: Gree Green Refrigeration Technology Center CO., LTD. of Zhuhai, Zhuhai (CN)

(72) Inventors: Yusheng Hu, Zhuhai (CN); Huijun Wei, Zhuhai (CN); Chuanshun Huang, Zhuhai (CN); Zhong Cui, Zhuhai (CN); Cheng Liu, Zhuhai (CN)

(73) Assignee: GREE GREEN REFRIGERATION TECHNOLOGY CENTER CO., LTD. OF ZHUHAI, Zhuhai (CN)

( * ) Notice: Subject to any disclaimer, the term of this patent is extended or adjusted under 35 U.S.C. 154(b) by 0 days.

(21) Appl. No.: 16/278,060

(22) Filed: Feb. 16, 2019

(65) Prior Publication Data

US 2019/0178237 A1 Jun. 13, 2019

Related U.S. Application Data

(63) Continuation of application No. PCT/CN2017/072034, filed on Jan. 22, 2017.

(30) Foreign Application Priority Data

Sep. 12, 2016 (CN) ..... 2016 1 0818635

(51) Int. Cl.
*F04B 35/04* (2006.01)

(52) U.S. Cl.
CPC ..... *F04B 35/04* (2013.01)

(58) Field of Classification Search
USPC ..... 92/140; 310/90.5
See application file for complete search history.

(56) References Cited

U.S. PATENT DOCUMENTS 3,422,765 A 1/1969 Schoch
3,731,984 A * 5/1973 Habermann ..... F16C 32/0444 310/90.5

(Continued)

FOREIGN PATENT DOCUMENTS

CN 105332890 A 2/2016
CN 105332891 A 2/2016

(Continued)

*Primary Examiner* — Peter J Bertheaud
*Assistant Examiner* — Geoffrey S Lee
(74) *Attorney, Agent, or Firm* — Kilpatrick Townsend & Stockton LLP

(57) ABSTRACT

Provided is a linear compressor comprising a cylinder, a piston, a cylinder shell, a linear motor stator, a magnetic levitation bearing and a mover. One end of the cylinder shell is sleeved on the cylinder, and another end of the cylinder shell is provided with a mounting cavity communicating with the cylinder cavity. A cavity wall of the mounting cavity is respectively provided with a stator mounting groove and a protrusion in a circumferential direction thereof. The linear motor stator is mounted in the stator mounting groove. The magnetic levitation bearing is disposed on the cavity wall of the mounting cavity. The mover includes a mover rod and a magnetic member disposed on the mover rod, and the mover rod is connected with the piston. The use of magnetic levitation bearing can avoid mechanical friction caused by direct contact of the mover with the linear motor stator.

8 Claims, 2 Drawing Sheets

(56) References Cited

U.S. PATENT DOCUMENTS

| | | | | | |
|---|---|---|---|---|---|
| 4,128,280 | A * | 12/1978 | Purtschert | F16C 17/03 | 310/90.5 |
| 4,473,259 | A * | 9/1984 | Goldowsky | F16C 32/0472 | 104/281 |
| 4,675,563 | A * | 6/1987 | Goldowsky | H02K 33/10 | 290/1 R |
| 4,889,039 | A * | 12/1989 | Miller | F04B 39/045 | 92/140 |
| 6,141,971 | A * | 11/2000 | Hanes | F25B 9/14 | 310/15 |
| 6,886,801 | B2 * | 5/2005 | Hallback | F16K 31/082 | 251/129.15 |
| 7,459,811 | B2 * | 12/2008 | Hyun | F04B 35/045 | 310/12.24 |
| 8,998,589 | B2 * | 4/2015 | Lilie | F04B 39/0044 | 417/417 |
| 9,369,031 | B2 * | 6/2016 | Sackl | H02K 33/00 | |
| 9,702,352 | B2 * | 7/2017 | Barito | F04B 35/045 | |
| 2004/0251748 | A1 * | 12/2004 | Inagaki | F04B 35/045 | 310/14 |
| 2007/0241621 | A1 * | 10/2007 | Hyun | F16B 21/186 | 310/23 |
| 2008/0219868 | A1 * | 9/2008 | Bonniface | F04B 35/045 | 417/415 |
| 2014/0313000 | A1 * | 10/2014 | Sackl | H02K 33/00 | 335/229 |

FOREIGN PATENT DOCUMENTS

| | | | | | |
|---|---|---|---|---|---|
| CN | 106246504 | A | | 12/2016 | |
| GB | 905095 | A | * | 9/1962 | F04B 35/045 |
| GB | 905095 | A | | 9/1962 | |
| JP | 11148736 | A | | 6/1999 | |

* cited by examiner

LINEAR COMPRESSOR

CROSS-REFERENCE TO RELATED APPLICATIONS

This application is a continuation application of PCT Patent Application No. PCT/CN2017/072034, entitled "LINEAR COMPRESSOR", filed on Jan. 22, 2017, which claims priority to Chinese Patent Application No. 2016/10818635.1, entitled "LINEAR COMPRESSOR", filed on Sep. 12, 2016, the entire contents of which are incorporated herein by reference.

FIELD OF TECHNOLOGY

This application relates to the technical field of a gas compression device, in particular to a linear compressor.

BACKGOUND

Most of the household refrigeration compressors currently widely used are rotary compressors, and a motor of the rotary compressor drives pistons to reciprocate. However, the unbalanced rotation mass of a crank, and the inertial force and the rotational friction which are generated by the movement of a connecting rod inevitably cause power loss. The conventional linear compressor only needs one set of friction pairs of a cylinder and a piston, and the driving direction of the piston is in the same line as its moving direction, so the corresponding friction power loss should be small. The reciprocating piston compressor currently used has four sets of friction pairs, so the mechanical efficiency of the linear compressor is theoretically much higher than that of the reciprocating piston compressor, but this is not the case. Because the piston of the linear compressor is rigidly connected with the mover, the piston cannot be ensured to be located at the center of a stator, which makes the piston generate a large lateral force to the cylinder, thereby increasing the frictional power loss and decreasing the mechanical efficiency. Therefore, it is necessary to improve the linear compressor, to reduce its frictional power loss and improve its mechanical efficiency.

SUMMARY

Based on this situation, it is necessary to provide a linear compressor that reduces the frictional power loss and improves the mechanical efficiency.

A linear compressor, comprising:

a cylinder provided with a cylinder cavity;

a piston disposed in the cylinder cavity;

a cylinder shell, one end of which is sleeved on the cylinder, another end of which is provided with a mounting cavity communicating with the cylinder cavity, wherein, a cavity wall of the mounting cavity is respectively provided with a stator mounting groove and a protrusion in a circumferential direction thereof;

a linear motor stator arranged in the stator mounting groove;

a magnetic levitation bearing disposed on the cavity wall of the mounting cavity;

a mover comprising mover rod and a magnetic member disposed on the mover rod, wherein, the mover rod is connected with the piston, the mover is arranged in an inner bore of the linear motor stator and in the magnetic levitation bearing, the magnetic levitation bearing is configured to provide a radial magnetic levitation force to the rotor, and the linear motor stator acts with the magnetic member to push the rotor, driving the piston to move in an axial direction; and a resonant spring, two ends of which are respectively connected with the mover rod and the protrusion, and the resonant spring can resonate with the mover.

The above-described linear compressor, the linear motor stator, the magnetic suspension bearing, the mover and the resonant spring are all located in the installation cavity, and the magnetic suspension bearing can avoid mechanical friction generated by the direct contact of the mover with the linear motor stator, and can ensure the piston and the cylinder to operate without contact, thereby reducing frictional power loss. In addition, the resonant spring is connected with the mover rod and the protrusion, and can resonate with the mover, so that the linear motor can drive the piston to work with a small driving force, thereby improving the mechanical efficiency of the linear compressor.

In an embodiment, the cavity wall of the mounting cavity is provided with a bearing mounting groove in the circumferential direction thereof, and the magnetic levitation bearing is disposed in the bearing mounting groove.

In an embodiment, the magnetic levitation bearing is disposed on at an end of the cavity wall of the mounting cavity adjacent to a cavity wall of the cylinder cavity.

In an embodiment, the cavity wall of the mounting cavity protrudes outward in the axial direction to form a bearing mounting groove, and the magnetic levitation bearing is disposed in the bearing mounting groove.

In an embodiment, an end of the mover rod is provided with a supporting bearing configured to support the mover rod by means of magnetic levitation; and the supporting bearing has magnetic permeability and is arranged inside the magnetic levitation bearing.

In an embodiment, the linear compressor further comprises a displacement sensor and a magnetic levitation bearing controller; the displacement sensor is disposed in a cavity wall of the cylinder cavity and configured to sense a shaft offset signal of the piston; the magnetic levitation bearing controller is electrically connected with the magnetic levitation bearing, the magnetic levitation bearing controller is configured to adjust a current in the magnetic levitation bearing according to the shaft offset signal, forcing the piston to return to the axial direction.

In an embodiment, a plurality of displacement sensors are provided, and the plurality of displacement sensors are evenly distributed on a periphery of the piston.

In an embodiment, the protrusion is disposed between the piston and the linear motor stator, and the resonant spring is sleeved on the mover.

In an embodiment, the linear motor stator is disposed between the piston and the protrusion, and the resonant spring is connected with an end of the mover rod.

In an embodiment, the linear motor stator is arranged in the stator mounting groove by an interference fit.

DETAILED DESCRIPTION OF EMBODIMENTS

In order to make the present invention more understandable, the present invention will be described more fully hereinafter with reference to the accompanying drawings. Preferred embodiments of the invention are shown in the accompanying drawings. However, the present invention may be embodied implemented in many different forms and is not limited to the embodiments described herein. Rather, these embodiments are provided so that the disclosure of the invention can be understood more thoroughly and completely.

It should be noted that when an element is referred to as "fixed" to another element, it may be disposed directly on another element or there may be an intermediate element therebetween. When an element is defined to be "connected" to another element, it can be directly connected to another element or meanwhile there may be an intermediate element.

Unless otherwise defined, all technical and scientific terms used herein have the same meanings as those commonly understood by those skilled in the art to which the present invention belongs. The terms used in the description of the present invention is only for the purpose of describing particular embodiments and is not intended to limit the invention. The term "and/or" as used herein includes any and all combinations of one or more associated listed items.

Figure 1:
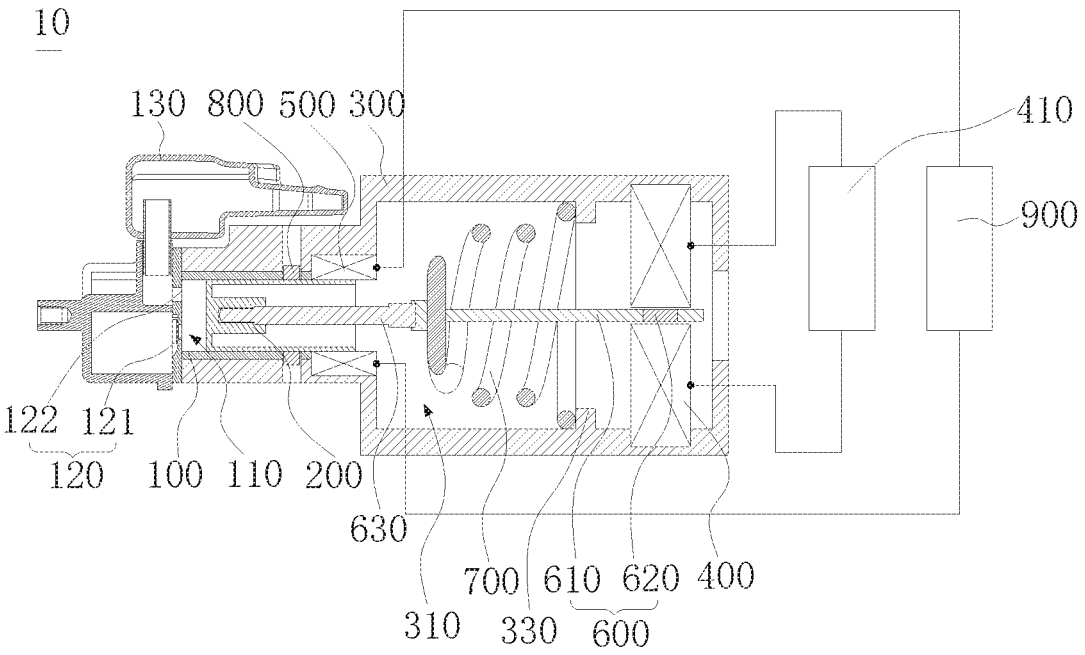
FIG. 1 is a cross-sectional view of a linear compressor according to an embodiment of the present invention.

Referring to FIG. 1, a linear compressor 10 of a preferred embodiment includes a cylinder 100, a piston 200, a cylinder shell 300, a linear motor stator 400, a magnetic levitation bearing 500, a mover 600, and a resonant spring 700.

The cylinder 100 is provided with a cylinder cavity 110. Specifically, the material of the cylinder 100 is selected from gray cast iron or ductile iron with good wear resistance.

The piston 200 is disposed inside the cylinder cavity 110. Specifically, the piston 200 is made of a magnetically permeable material such as No. 10 steel. The piston 200 reciprocates within the cylinder cavity 110 to complete the gas compression and the gas exhaust.

Figure 2:
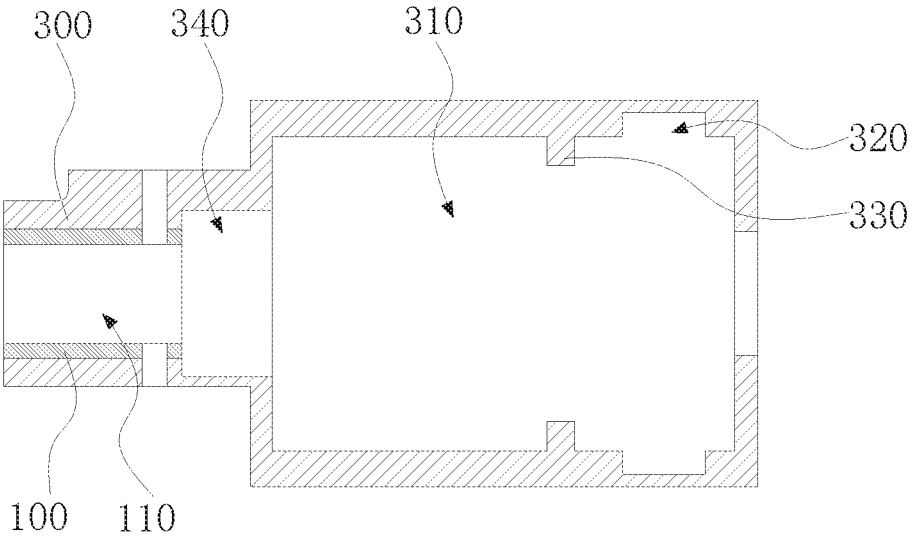
FIG. 2 is a structural view of a cylinder and a cylinder shell of the linear compressor shown in FIG. 1.

Referring to FIGS. 1 and 2, one end of the cylinder shell 300 is sleeved on the cylinder 100, and the other end of the cylinder shell 300 is provided with a mounting cavity 310. The mounting cavity 310 is in communication with the cylinder cavity 110. The cavity wall of the mounting cavity 310 is respectively provided with a stator mounting groove 320 and a projection 330 in a circumferential direction thereof.

Specifically, in the present embodiment, the protrusion 330 is disposed between the piston 200 and the linear motor stator 400. That is, the stator mounting groove 320 is provided at one end of the mounting cavity 310 away from the cylinder 100.

Specifically, the cavity wall of the mounting cavity 310 is provided with two protrusions 330 in the circumferential direction thereof, which are oppositely disposed. It can be understood that the protrusions 330 are also annular.

The material of the cylinder shell 300 is selected from a non-magnetic material or a weak magnetic material, such as cast aluminum alloy, which, on one hand, can reduce the weight of the whole machine and reduce the vibration of the machine body, and on the other hand, can reduce the loss of magnetic leakage of the linear motor and improve the efficiency of the linear motor and the magnetic levitation bearing 500.

The linear motor stator 400 is arranged in the stator mounting groove 320. It will be understood that the linear motor stator 400 is driven by the linear motor. Specifically, the linear motor stator 400 is arranged in the stator mounting groove 320 by an interference fit.

Specifically, the linear compressor 10 further includes a linear motor controller 410 electrically connected with the linear motor stator 400. According to different loads of the linear compressor 10 in operation, the linear motor controller 410 controls the stroke of the reciprocating linear motion of the piston 200 in the cylinder cavity 310, and adjusts the gas amount delivered according to different operating conditions.

The magnetic levitation bearing 500 is disposed on the cavity walls of the mounting cavity 310. The mover 600 is mounted in the magnetic levitation bearing 500 which provides radial magnetic levitation forces to the mover 600. The magnetic levitation bearing 500 avoids the mechanical friction generated by the direct contact of the mover 600 with the linear motor stator 400, which ensures the piston 200 to operate without contact with the cylinder 100, and ensures the mechanical efficiency to be theoretically close to 100%. Moreover, the magnetic levitation bearing 500 is provided and no oil pumps are required, so that the linear compressor 10 is more compact in structure, which is advantageous in reducing the volume and the cost of the linear compressor 10.

The mover 600 includes a mover rod 610 and a magnetic member 620 disposed on the mover rod 610. The mover rod 610 is connected with the piston 200. The mover 600 is arranged in the inner bore of the linear motor stator 400. The linear motor stator 610 acts with the magnetic member 620 to push the mover 600, driving the piston 200 to move in an axial direction.

Specifically, the alternating magnetic field generated by the linear motor stator 400 acts with the magnetic member 620 to push the mover 600, driving the piston 200 to move in the axial direction. It can be understood that the linear motor stator 400 is provided with a coil (not shown), and the coil generates an alternating magnetic field after the linear motor 10 is connected to the alternating power supply.

Specifically, the magnetic member 620 is disposed inside the mover rod 610 and disposed in the inner bore of the linear motor stator 400.

Specifically, the 610 is preferably a cast aluminum member. The mover rod 610 and the magnetic member 620 can be integrally die-cast. Specifically, in the embodiment, the magnetic member 620 is a magnet Specifically, the linear compressor 10 further includes a connecting rod 630, through which the piston 200 is connected with the mover rod 610. Specifically, the connecting rod 630 is made of a material with large radial rigidity, such as No. 45 alloy steel.

Continuing to refer to FIG. 2, specifically, in the present embodiment, the cavity wall of the mounting cavity 310 is provided with a bearing mounting groove 340 in the circumferential direction thereof, and the magnetic levitation bearing 500 is disposed in the bearing mounting groove 340. More specifically, the magnetic levitation bearing 340 is located at one end of the cavity wall of the mounting cavity 310 adjacent to the cavity wall of the cylinder cavity 110. The bearing mounting groove 340 is disposed on the cavity wall of the mounting cavity 310 in the circumferential direction, which is advantageous in reducing the volume of the linear compressor 10.

Figure 3:
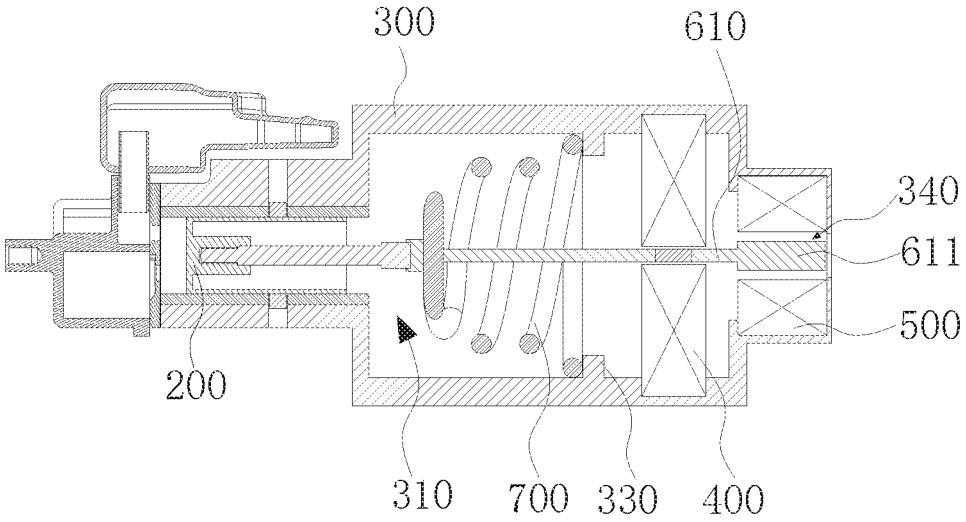
FIG. 3 is a cross-sectional view of a linear compressor according to another embodiment of the present invention.

Referring to FIG. 3, in another embodiment, specifically, the cavity wall of the mounting cavity 310 protrudes outward in the axial direction to form a bearing mounting groove 340, and the magnetic levitation bearing 500 is disposed in the bearing mounting groove 340. Thus, the bearing mounting groove 340 supports the magnetic levitation bearing 500, which not only facilitates the installation of the magnetic levitation bearing 500, but also makes the mounting more stable. More specifically, the end of the mover rod 610 is provided with a supporting bearing 611 having magnetic permeability, and the supporting bearing 611 is arranged in the magnetic levitation bearing 340 to support the rotor support 610 by magnetic levitation.

The linear compressor 10 also includes a displacement sensor 800 and a magnetic levitation bearing controller 900. The displacement sensor 800 is provided at the cavity wall of the cylinder cavity 110 and is configured to sense the shaft offset signal of the piston 200. The magnetic levitation bearing controller 900 is electrically connected with the magnetic levitation bearing 500, and the magnetic levitation bearing controller 900 is capable of adjusting the current in the magnetic levitation bearing 500 according to the shaft offset signal, forcing the piston 200 to return to the axial direction. Thus, the piston 200 is prevented from generating a large lateral force on the cylinder 100, thereby ensuring the piston 200 to operate within the cylinder 100 without friction, and improving the mechanical efficiency of the linear compressor 10.

A plurality of displacement sensors 800 are provided. The plurality of displacement sensors 800 are evenly distributed on the periphery of the piston 200. Specifically, in the present embodiment, the number of displacement sensors 800 is four, to obtain more accurate shaft offset signals. Specifically, the displacement sensor 800 is an eddy current displacement sensor or an LVDT displacement sensor.

Two ends of the resonant spring 700 are connected with the mover rod 610 and the protrusion 330, respectively. The resonant spring 700 resonates with the mover 600, which enables the linear motor to drive the piston 200 to work with a small driving force, thereby improving the mechanical efficiency of the linear compressor 10. Moreover, one resonant spring 700, rather than a plurality of cylindrical springs, is directly connected with the mover rod 610, which reduces the weight of the moving assembly and the load of the magnetic levitation and is advantageous for the linear compressor 10 to operate at a high frequency.

Specifically, in this embodiment, the resonant spring 700 is sleeved on the mover 600, which is advantageous in reducing the volume of the linear compressor 10 and better ensures that the mover 600 moves in the axial direction, thereby reducing the lateral force between the piston 200 and the cylinder 100.

Specifically, the resonant spring 700 and the protrusion 330 are welded together by laser welding or argon arc welding. The resonant spring 700 and the mover rod 610 are integrally die-cast. Specifically, the rigidity of the resonant spring 700 is set according to the actual operating frequency of the linear compressor 10. Specifically, the operating frequency of the linear compressor 10 is generally from 50 Hz to 120 Hz, and therefore the rigidity of the resonant spring 700 is generally from 60 N/mm to 120 N/mm.

Figure 4:
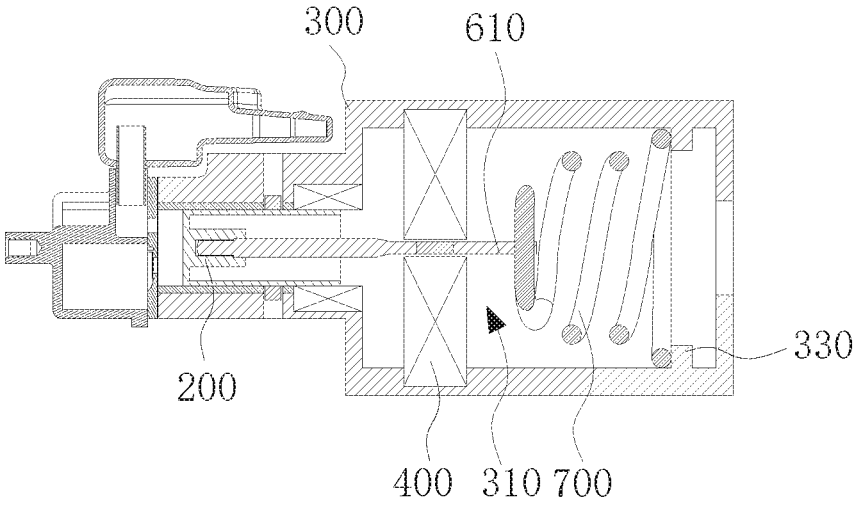
FIG. 4 is a cross-sectional view of a linear compressor according to still another embodiment of the present invention.

Referring to FIG. 4, specifically, in still another embodiment, the linear motor stator 400 is disposed between the piston 200 and the projection 330. That is, the stator mounting groove 320 is disposed at one end of the mounting cavity 310 adjacent to the cylinder 100. Specifically, the resonant spring 700 is connected with an end of the mover rod 610, thus the resonant spring 700 acts on a free end of the mover rod 610, which is advantages for the resonance spring 700 to better resonate with the mover 600, thereby further reducing the power loss of the linear compressor 10.

Continuing to refer to FIG. 1, specifically, the linear compressor 10 further includes a valve assembly 120 which is disposed on the cylinder 100 and communicates with the cylinder cavity 110. The valve assembly 120 includes an intake valve 121 and an exhaust valve 122 which communicate with the cylinder cavity 110, respectively, and which are configured to control gas suction and exhaust of the linear compressor 10, respectively.

Specifically, the linear compressor 10 further includes a muffler 130 configured to silence the suction and the exhaust of the linear compressor 10. Specifically, in the embodiment, the muffler 130 is a suction muffler. Specifically, the suction muffler 130 is generally a plastic member with large damping, such as PBT (polybutylene terephthalate), PET (polyethylene terephthalate), PPS (polyphenylene sulfide), and so on.

The technical features of the above-described embodiments may be combined in any forms. In order to make the description more concise, not all possible combinations of the technical features in the above-described embodiments are described. However, as long as there are no contradictions between the combinations of these technical features, all combinations should be considered as the scope of this specification.

The above-described embodiments are merely several illustrative embodiments of the present invention, and the description thereof is more specific and detailed, but these embodiments should not be understood to limit the scope of the invention. It should be pointed out that several variations and modifications may be made by those skilled in the art without departing from the concepts of the invention, and the several variations and modifications belong to the protection scope of the invention. Therefore, the protection scope of the invention should be determined by the appended claims.

What is claimed is:

1. A linear compressor, characterized by comprising:

a cylinder provided with a cylinder cavity;

a piston disposed in the cylinder cavity;

a cylinder shell, one end of which is sleeved on the cylinder, another end of which is provided with a mounting cavity communicating with the cylinder cavity, wherein, a cavity wall of the mounting cavity is respectively provided with a stator mounting groove and a protrusion in a circumferential direction thereof; the protrusion is disposed on an inner cavity wall of the mounting cavity;

a linear motor stator arranged in the stator mounting groove; the protrusion is disposed between the piston and the linear motor stator;

a magnetic levitation bearing disposed on the cavity wall of the mounting cavity;

a mover comprising a mover rod and a magnetic member disposed on the mover rod;

wherein, the mover rod is connected with the piston, the mover is arranged in an inner bore of the linear motor stator and in the magnetic levitation bearing; the magnetic levitation bearing is configured to provide a radial magnetic levitation force to the mover; and the linear motor stator acts with the magnetic member to push the mover, driving the piston to move in an axial direction; and a resonant spring, two ends of which are respectively connected with the mover rod and the protrusion; the resonant spring is sleeved on the mover; and the resonant spring is configured to resonate with the mover.

2. The linear compressor according to claim 1, wherein, the cavity wall of the mounting cavity is provided with a bearing mounting groove in the circumferential direction thereof, and the magnetic levitation bearing is disposed in the bearing mounting groove.

3. The linear compressor according to claim 2, wherein, the magnetic levitation bearing is disposed on an end of the cavity wall of the mounting cavity adjacent to a cavity wall of the cylinder cavity.

4. The linear compressor according to claim 1, wherein, the cavity wall of the mounting cavity protrudes outward in the axial direction from a recess in the mounting cavity to form a bearing mounting groove, and the magnetic levitation bearing is disposed in the bearing mounting groove.

5. The linear compressor according to claim 4, wherein, an end of the mover rod is provided with a bearing rotor configured to support the mover rod by means of magnetic levitation; and the bearing rotor has magnetic permeability and is arranged inside the magnetic levitation bearing.

6. The linear compressor according to claim 1, wherein, the linear compressor further comprises a displacement sensor and a magnetic levitation bearing controller;

the displacement sensor is disposed in the cavity wall of the cylinder cavity and configured to sense a shaft offset signal of the piston; the magnetic levitation bearing controller is electrically connected with the magnetic levitation bearing.

7. The linear compressor according to claim 6, wherein, a plurality of displacement sensors are provided, and the plurality of displacement sensors are evenly distributed on a periphery of the piston.

8. The linear compressor according to claim 1, wherein, the linear motor stator is arranged in the stator mounting groove by interference fit.

* * * * *